US006659676B2

(12) United States Patent
Zheng

(10) Patent No.: US 6,659,676 B2
(45) Date of Patent: Dec. 9, 2003

(54) PART RECYCLE DEVICE OF A DOCUMENT FILE

(76) Inventor: Zhi-Yuan Zheng, 58, Ma Yuan West St., Taichung (TW)

( * ) Notice: Subject to any disclaimer, the term of this patent is extended or adjusted under 35 U.S.C. 154(b) by 42 days.

(21) Appl. No.: 10/047,359

(22) Filed: Jan. 11, 2002

(65) Prior Publication Data

US 2003/0133742 A1 Jul. 17, 2003

(51) Int. Cl.[7] ..... B42F 3/00

(52) U.S. Cl. ..... 402/60; 24/67 R; 24/67.11; 281/15.1; 281/29; 402/63; 402/73; 402/502; D19/26

(58) Field of Search ..... 402/63, 60, 62, 402/70, 73, 75, 500, 80 R, 502, 80 P; 281/15.1, 21.1, 29, 36, 37, 38; 24/67 R, 67.1, 67.9, 67.11; D19/26, 27

(56) References Cited

U.S. PATENT DOCUMENTS 4,180,340 A * 12/1979 Cosby ..... 402/63
4,964,746 A * 10/1990 Huang ..... 402/25
5,209,593 A * 5/1993 Ros ..... 402/77
5,653,544 A * 8/1997 Cabre Pijoan et al. ..... 402/64
5,722,783 A * 3/1998 Kiyomi ..... 402/70
6,174,100 B1 * 1/2001 Song ..... 402/60

FOREIGN PATENT DOCUMENTS

JP 6092080 * 4/1994

* cited by examiner

*Primary Examiner*—Monica Carter

(57) ABSTRACT

A part recycle device of a document file includes two spaced first through holes formed in a clamping member, two spaced second through holes formed in a side wall of an outer plate, two screw members, a press plate, and two nuts. Each of the two screw members extends through one of the two spaced first through holes and one of the two spaced second through holes. The press plate has a first end face formed with two spaced third through holes, and a second end face provided with two spaced protruding rings each formed with a polygonal recess aligning with one of the two spaced third through holes. Each of the two nuts is received in the polygonal recess of one of the two spaced protruding rings of the press plate, and may be engaged with one of the two screw members.

2 Claims, 8 Drawing Sheets

PART RECYCLE DEVICE OF A DOCUMENT FILE

BACKGROUND OF THE INVENTION

1. Field of the Invention

The present invention relates to a part recycle device of a document file, and more particularly to a part recycle device of a document file, wherein when the document file is worn out, the clamping member may be detached from the side wall of the outer plate easily and conveniently by the part recycle device, thereby dismantling the document file, so that the parts of the document file, such as the clamping member and the outer plate, may be restored and reused.

2. Description of the Related Art

A conventional document file in accordance with the prior art comprises an outer plate bent into two side walls, and a clamping member fixed on one side wall of the outer plate for retaining papers therein. The clamping member is fixed on one side wall of the outer plate by riveting, so that the clamping member cannot be detached from the outer plate. Thus, when the part of the conventional document file, such as the clamping member or the outer plate, is worn-out during a long-term utilization, the part of the conventional document file cannot be restored and reused, and the user has to throw away the entire document file, thereby causing consumption of material, and thereby causing an environmental problem.

SUMMARY OF THE INVENTION

The present invention has arisen to mitigate and/or obviate the disadvantage of the conventional document file.

The primary objective of the present invention is to provide a part recycle device of a document file, wherein the clamping member may be secured on the side wall of the outer plate rigidly and stably by the part recycle device, thereby assembling the document file.

Another objective of the present invention is to provide a part recycle device of a document file, wherein when the document file is worn out, the clamping member may be detached from the side wall of the outer plate easily and conveniently by the part recycle device, thereby dismantling the document file, so that the parts of the document file, such as the clamping member and the outer plate, may be restored and reused.

A further objective of the present invention is to provide a part recycle device of a document file, wherein the screw member may be unscrewed from the nut to detach the clamping member and the press plate from the outer plate, so that the parts of the document file, such as the clamping member and the outer plate, may be assembled and dismantled easily and conveniently.

A further objective of the present invention is to provide a part recycle device of a document file, wherein the width or the length of the press plate of the part recycle device may be increased, and the press plate of the part recycle device may be formed with a sheet receiving groove for receiving a paper sheet which is provided with characters, documents or the like, for inquiry of the user.

A further objective of the present invention is to provide a part recycle device of a document file, wherein the protruding ring of the press plate is formed with a polygonal recess for securing the nut, so that the screw member may be screwed with the nut easily and conveniently.

In accordance with the present invention, there is provided a part recycle device of a document file, comprising two spaced first through holes, two spaced second through holes, two screw members, a press plate, and two nuts, wherein:

the two spaced first through holes are formed in a clamping member;

the two spaced second through holes are formed in a side wall of an outer plate;

each of the two screw members may in turn extend through one of the two spaced first through holes of the clamping member, and through one of the two spaced second through holes of the outer plate;

the press plate has a first end face formed with two spaced third through holes each aligning with one of the two spaced second through holes of the outer plate, the press plate has a second end face provided with two spaced protruding rings each aligning with one of the two spaced third through holes, each of the two spaced protruding rings of the press plate is formed with a polygonal recess aligning with one of the two spaced third through holes; and each of the two nuts is received in the polygonal recess of one of the two spaced protruding rings of the press plate, and may be engaged with one of the two screw members.

Further benefits and advantages of the present invention will become apparent after a careful reading of the detailed description with appropriate reference to the accompanying drawings.

DETAILED DESCRIPTION OF THE INVENTION

Figure 1:
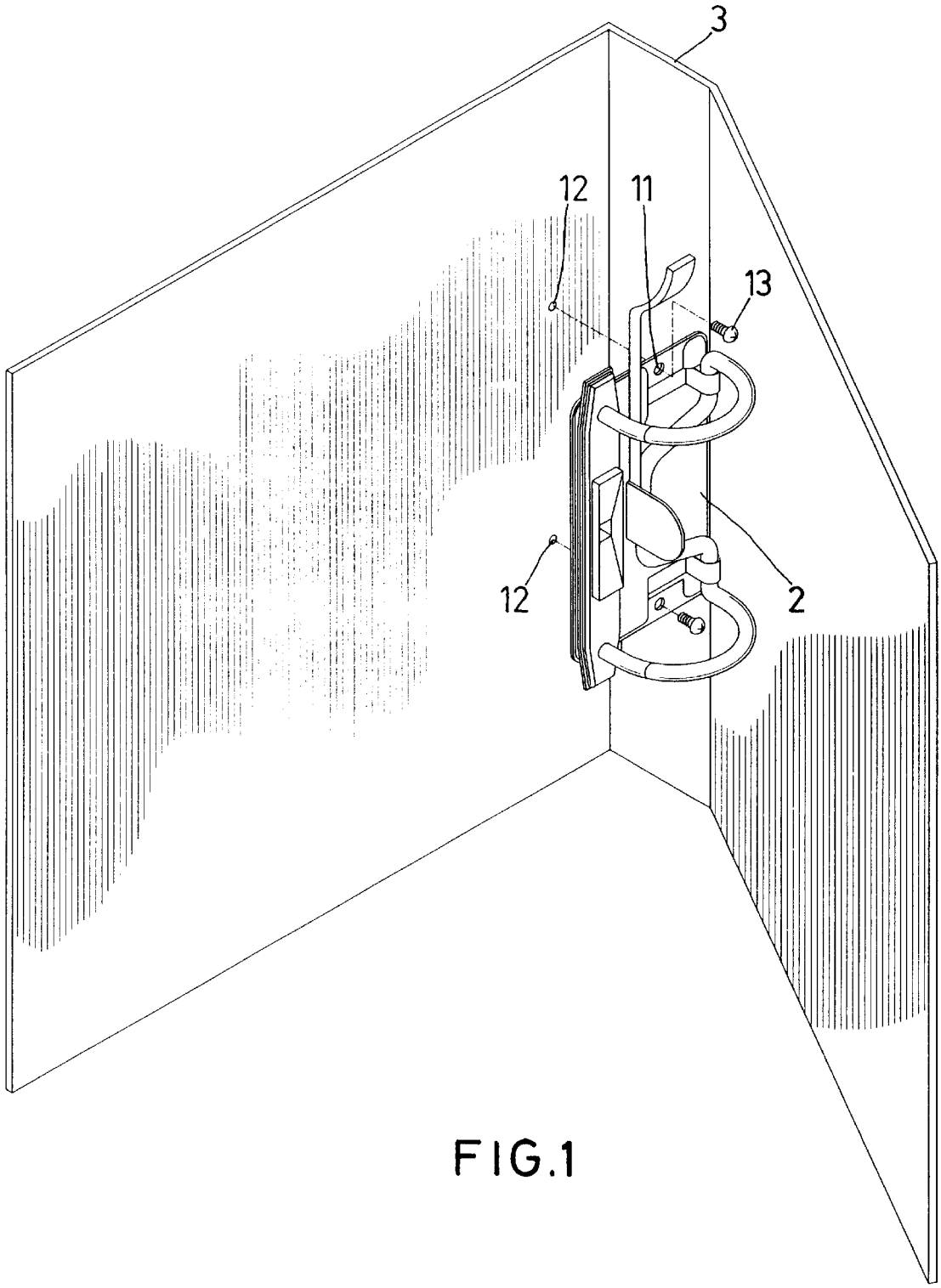
FIG. 1 is a partially exploded perspective view of a part recycle device of a document file in accordance with a first embodiment of the present invention.
Figure 2:
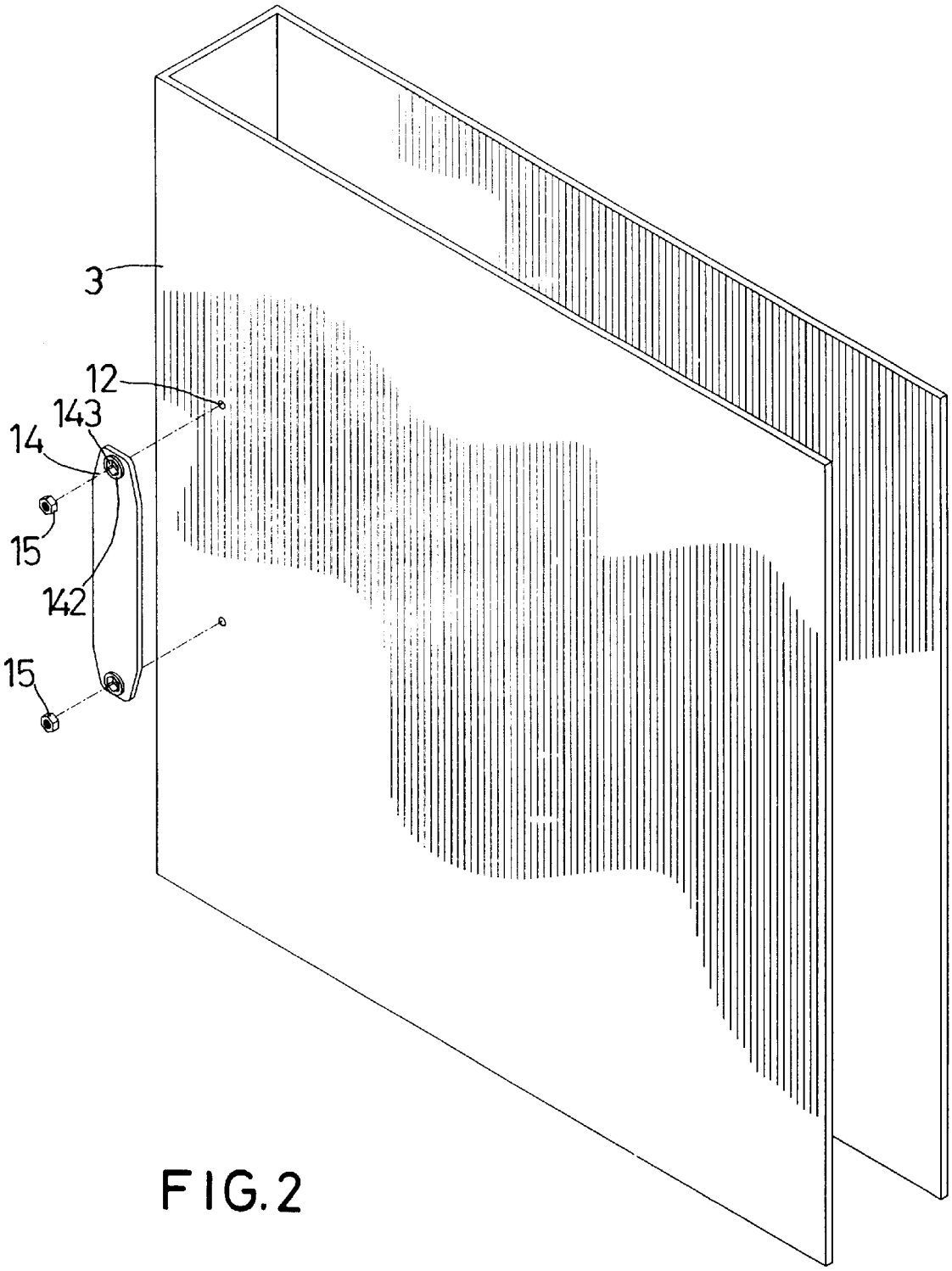
FIG. 2 is a partially exploded perspective view of a part recycle device of a document file in accordance with a first embodiment of the present invention.
Figure 3:
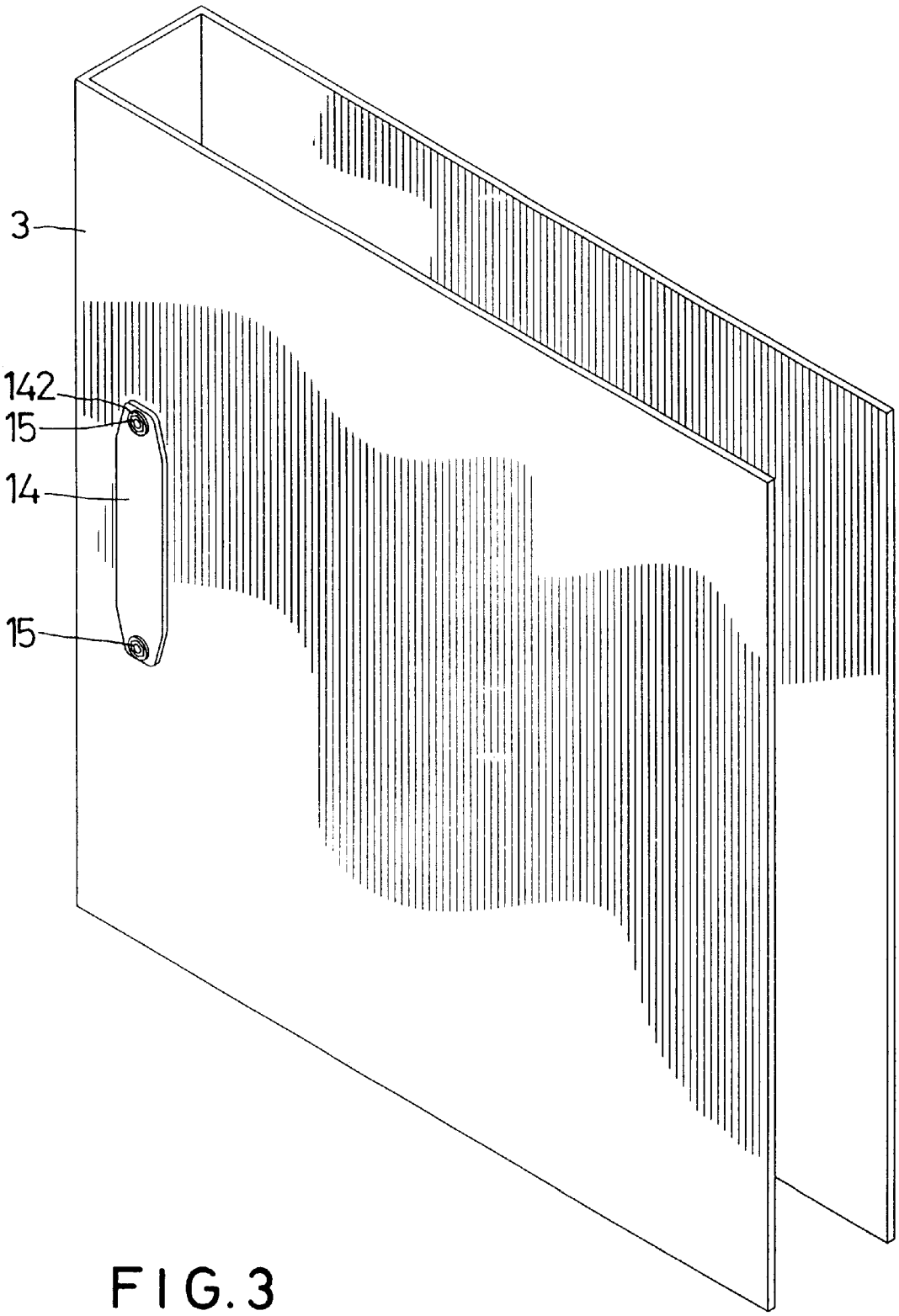
FIG. 3 is a perspective assembly view of the part recycle device of a document file as shown in FIG. 2.
Figure 4:
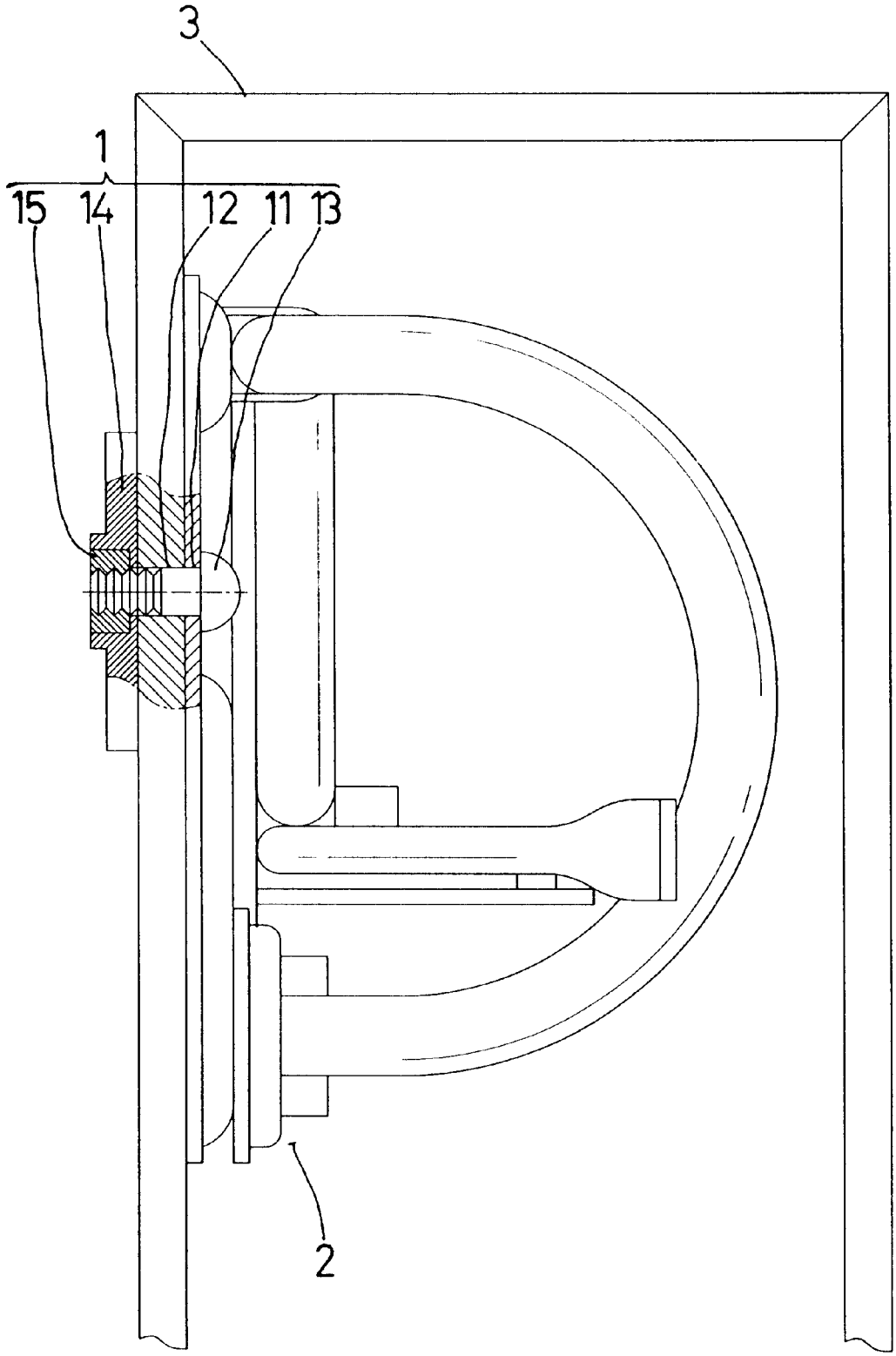
FIG. 4 is a side plan cross-sectional assembly view of the part recycle device of a document file as shown in FIG. 3.
Figure 5:
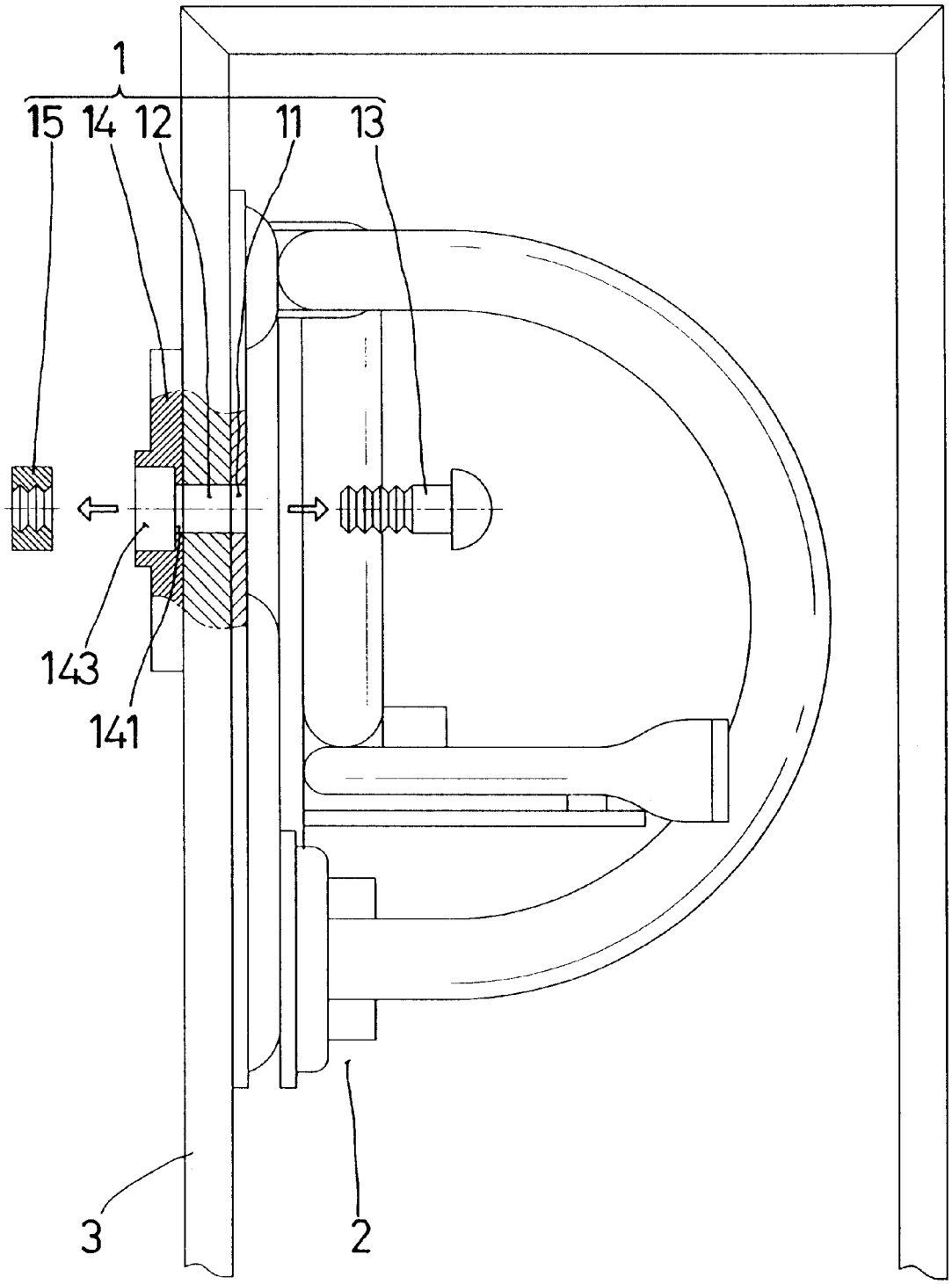
FIG. 5 is a side plan cross-sectional exploded view of the part recycle device of a document file as shown in FIG. 3.

Referring to the drawings and initially to FIGS. 1–5, a part recycle device 1 of a document file in accordance with a first embodiment of the present invention comprises two spaced first through holes 11, two spaced second through holes 12, two screw members 13, a press plate 14, and two nuts 15.

The two spaced first through holes 11 are formed in a clamping member 2.

The two spaced second through holes 12 are formed in a side wall of an outer plate 3.

Each of the two screw members 13 may in turn extend through one of the two spaced first through holes 11 of the clamping member 2, and through one of the two spaced second through holes 12 of the outer plate 3.

The press plate 14 has a first end face formed with two spaced third through holes 141 each aligning with one of the two spaced second through holes 12 of the outer plate 3.

The press plate 14 has a second end face provided with two spaced protruding rings 142 each aligning with one of the two spaced third through holes 141. Each of the two spaced protruding rings 142 of the press plate 14 is formed with a polygonal recess 143 aligning with one of the two spaced third through holes 141.

Each of the two nuts 15 is received in the polygonal recess 143 of one of the two spaced protruding rings 142 of the press plate 14, and may be engaged with one of the two screw members 13.

In assembly, the back face of the clamping member 2 is rested on the inner face of the side wall of the outer plate 3, with the two spaced first through holes 11 of the clamping member 2 aligning with the two spaced second through holes 12 of the outer plate 3. Then, each of the two screw members 13 may in turn extend through one of the two spaced first through holes 11 of the clamping member 2, through one of the two spaced second through holes 12 of the outer plate 3, and through one of the two spaced third through holes 141 of the press plate 14, and may be screwed into one of the two nuts 15 in the polygonal recess 143 of one of the two spaced protruding rings 142 of the press plate 14, so that the clamping member 2 may be secured on the side wall of the outer plate 3 rigidly and stably, thereby assembling the document file.

Figure 6:
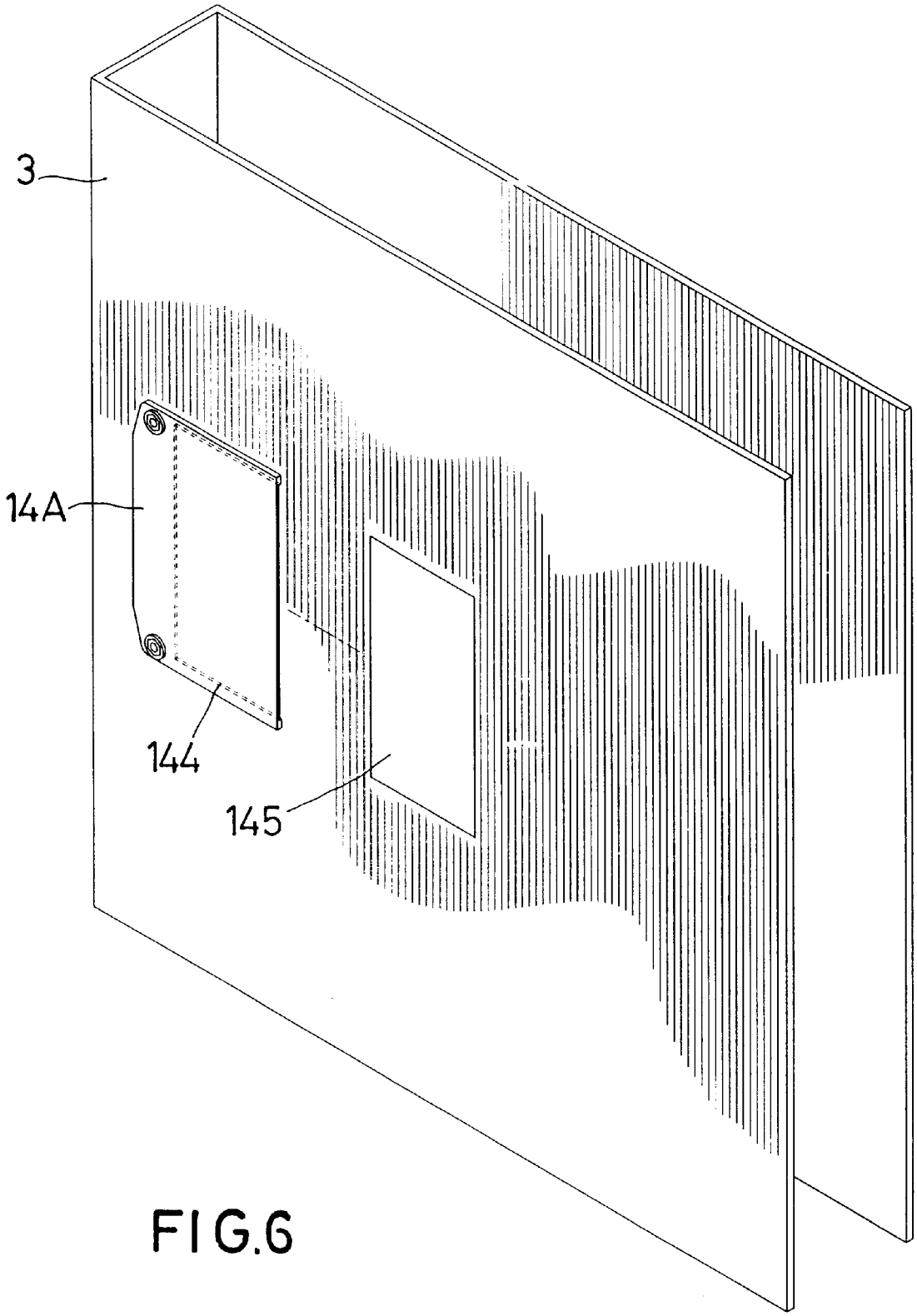
FIG. 6 is a perspective view of a part recycle device of a document file in accordance with a second embodiment of the present invention.

Referring to FIG. 6, in accordance with a second embodiment of the present invention, the width of the press plate 14A of the part recycle device 1 may be increased. The press plate 14A of the part recycle device 1 is made of transparent material, and is formed with a sheet receiving groove 144 for receiving a paper sheet 145 which is provided with characters, documents or the like.

Figure 7:
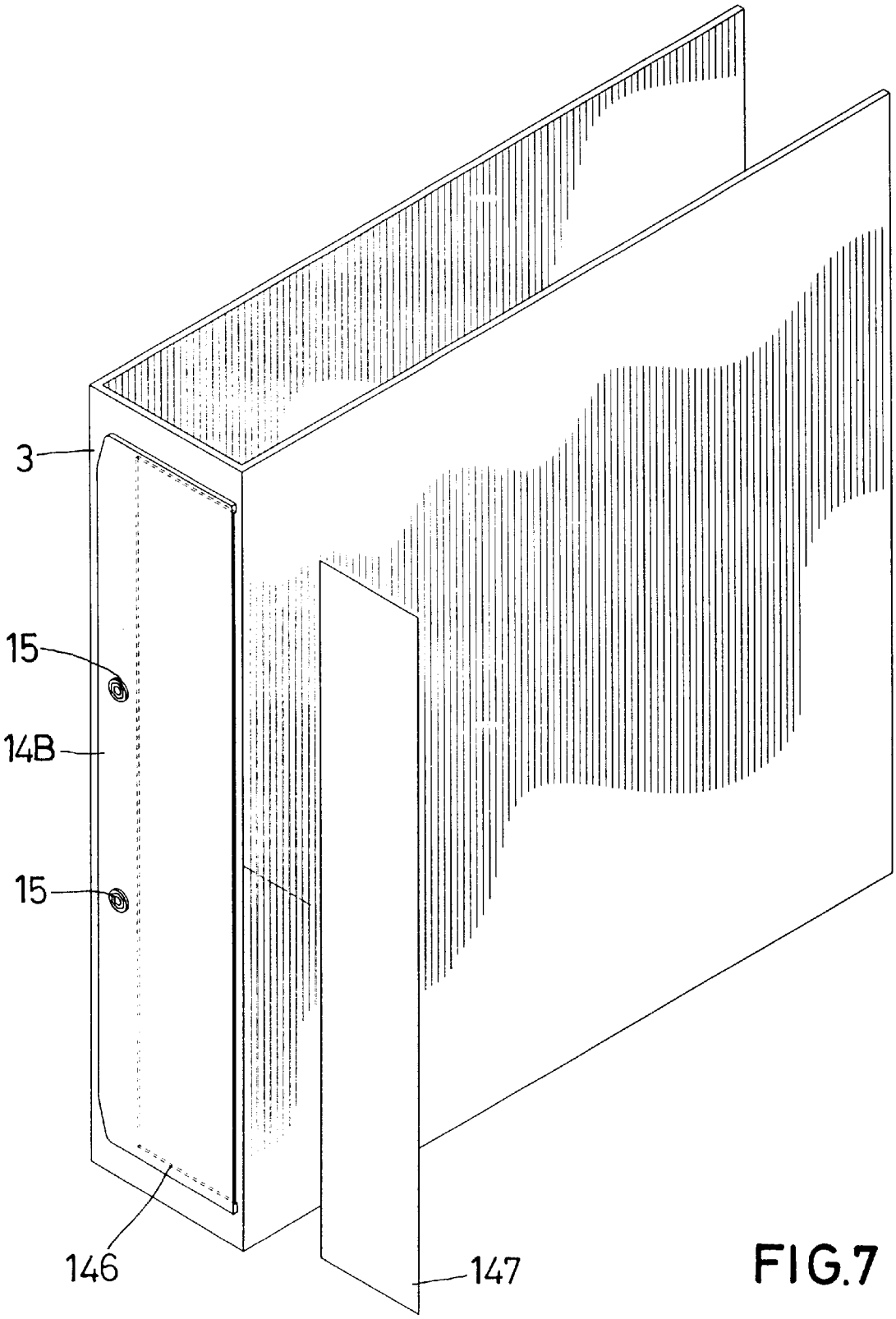
FIG. 7 is a perspective view of a part recycle device of a document file in accordance with a third embodiment of the present invention.

Referring to FIG. 7, in accordance with a third embodiment of the present invention, the width and the length of the press plate 14B of the part recycle device 1 may be increased. The press plate 14B of the part recycle device 1 is made of transparent material, and is formed with a sheet receiving groove 146 for receiving a paper sheet 147 which is provided with characters, documents or the like.

Figure 8:
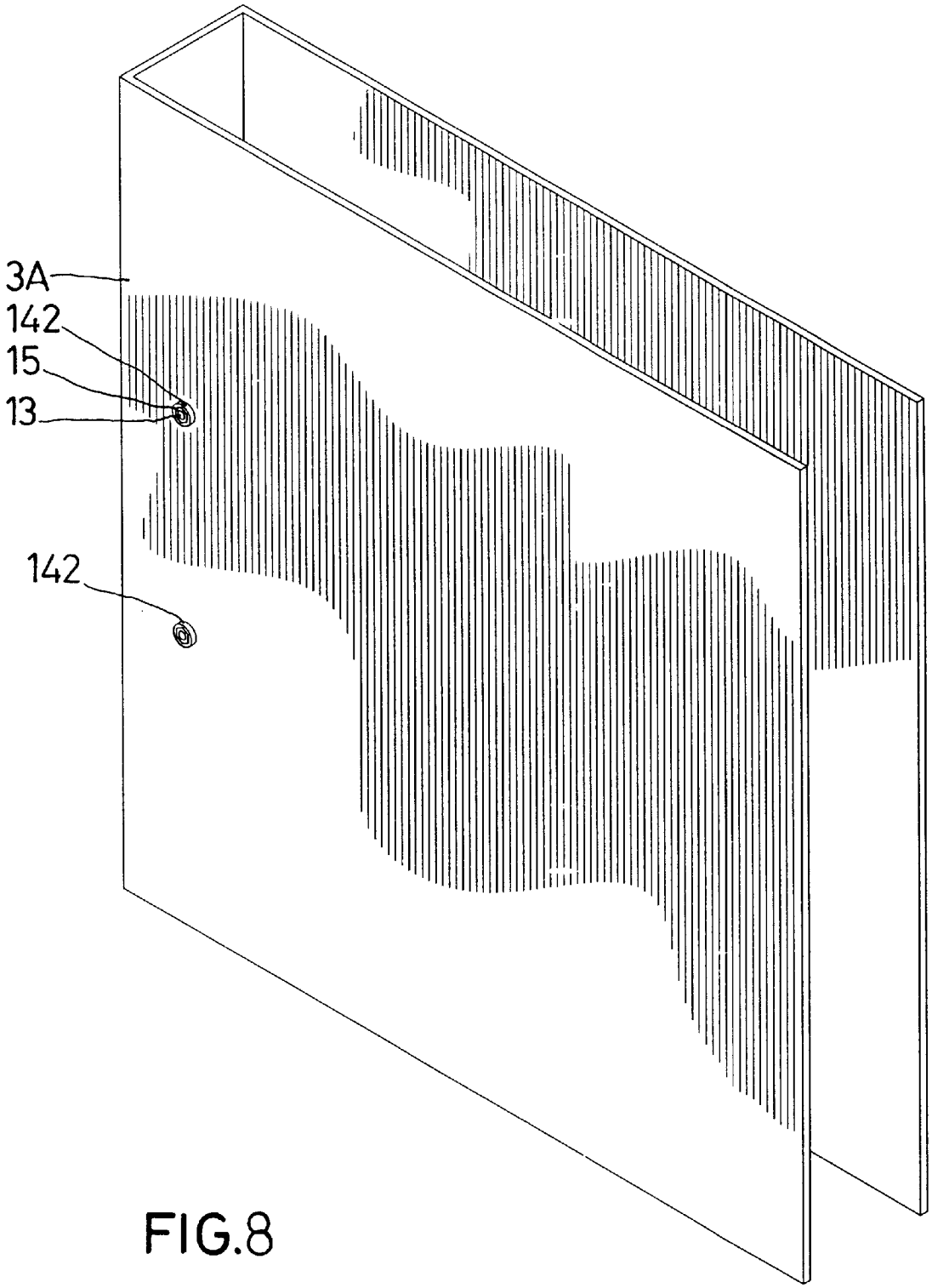
FIG. 8 is a perspective view of a part recycle device of a document file in accordance with a fourth embodiment of the present invention.

Referring to FIG. 8, in accordance with a fourth embodiment of the present invention, the press plate 14 is undefined, and the outer end face of the outer plate 3A is integrally formed with the two spaced third through holes 141, the two spaced protruding rings 142, and the polygonal recess 143 in each of the two spaced protruding rings 142.

Accordingly, the part recycle device 1 of a document file in accordance with the present invention has the following advantages.

1. The clamping member 2 may be secured on the side wall of the outer plate 3 rigidly and stably by the part recycle device 1, thereby assembling the document file.
2. When the document file is worn out, the clamping member 2 may be detached from the side wall of the outer plate 3 easily and conveniently by the part recycle device 1, thereby dismantling the document file, so that the parts of the document file, such as the clamping member 2 and the outer plate 3, may be restored and reused.
3. The screw member 13 may be unscrewed from the nut 15 to detach the clamping member 2 and the press plate 14 from the outer plate 3, so that the parts of the document file, such as the clamping member 2 and the outer plate 3, may be assembled and dismantled easily and conveniently.
4. The width or the length of the press plate 14B of the part recycle device 1 may be increased, and the press plate 14B of the part recycle device 1 may be formed with a sheet receiving groove 146 for receiving a paper sheet 147 which is provided with characters, documents or the like, for inquiry of the user.
5. The protruding ring 142 of the press plate 14 is formed with a polygonal recess 143 for securing the nut 15, so that the screw member 13 may be screwed with the nut 15 easily and conveniently.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A part recycle device of a document file, comprising two spaced first through holes, two spaced second through holes, two screw members, a press plate, and two nuts, wherein:

the two spaced first through holes are formed in a clamping member;

the two spaced second through holes are formed in a side wall of an outer plate;

each of the two screw members extend through one of the two spaced first through holes of the clamping member, and through one of the two spaced second through holes of the outer plate;

the press plate has a first end face formed with two spaced third through holes each aligning with one of the two spaced second through holes of the outer plate, the press plate has a second end face provided with two spaced protruding rings each aligning with one of the two spaced third through holes, each of the two spaced protruding rings of the press plate is formed with a polygonal recess aligning with one of the two spaced third through holes;

each of the two nuts is received in the polygonal recess of one of the two spaced protruding rings of the press plate, and is engaged with one of the two screw members; and the width of the press plate can be increased, and the press plate is made of transparent material and is formed with a sheet receiving groove for receiving a paper sheet.

2. The part recycle device of a document file in accordance with claim 1, wherein the length of the press plate can be increased.

* * * * *